US007004324B1

(12) United States Patent
Delorio

(10) Patent No.: US 7,004,324 B1
(45) Date of Patent: Feb. 28, 2006

(54) MULTI-COMPARTMENT PILL CONTAINER

(76) Inventor: Lorraine Delorio, 749 E. Veterans Hwy., Jackson, NJ (US) 10817

( * ) Notice: Subject to any disclaimer, the term of this patent is extended or adjusted under 35 U.S.C. 154(b) by 144 days.

(21) Appl. No.: 10/716,153

(22) Filed: Nov. 18, 2003

(51) Int. Cl.
*B65D 71/00* (2006.01)
*B65D 83/04* (2006.01)

(52) U.S. Cl. ..... 206/570; 206/534; 206/538

(58) Field of Classification Search ..... 206/528–534, 206/538–539, 499, 570, 803
See application file for complete search history.

(56) References Cited

U.S. PATENT DOCUMENTS 1,717,060 A * 6/1929 Mottayaw ..... 40/324
3,285,459 A * 11/1966 Gahm ..... 220/8
4,372,445 A * 2/1983 Keffeler ..... 206/532
4,735,318 A * 4/1988 Keffeler ..... 206/532
4,749,085 A * 6/1988 Denney ..... 206/534
4,793,492 A * 12/1988 Halbich ..... 206/538
4,890,471 A 1/1990 Ito ..... 206/534
4,940,138 A * 7/1990 Hornstein ..... 206/218
5,240,113 A * 8/1993 Gibilisco ..... 206/534
5,267,650 A * 12/1993 Gilbilisco ..... 206/534
5,720,392 A 2/1998 Price ..... 206/534
5,735,406 A * 4/1998 Keffeler ..... 206/535
5,899,335 A 5/1999 Boyer et al. ..... 206/538
6,126,010 A * 10/2000 Kogen ..... 206/570
6,631,805 B1 * 10/2003 Bramen ..... 206/538
6,662,081 B1 * 12/2003 Jacober et al. ..... 700/242

* cited by examiner

*Primary Examiner*—Jila M. Mohandesi
(74) *Attorney, Agent, or Firm*—Goldstein Law Offices, P.C.

(57) ABSTRACT

A multi-compartment pill container constructed to hold a week's worth of medication for a user. The container has a housing having a top surface, a number of removable compartments held within the rectangular openings in the top surface of the housing, and a lid attached to the housing and extending over the compartments. Each compartment is divided into chambers by separation walls. Each chamber has a chamber cover on which indicia is printed. The indicia includes abbreviations for the days of the week for each of the compartments, as well as times of the day for each of the chambers. At the correct time, the user ingests the medication from the appropriate chamber. The container also includes a telescopic drinking cup to aid in the taking of medication and a timer to notify the user to take the medication. Each compartment may be completely removed from the housing to allow the user to carry the compartment separate from the entire container.

4 Claims, 3 Drawing Sheets

MULTI-COMPARTMENT PILL CONTAINER

BACKGROUND OF THE INVENTION

The invention relates to a multi-compartment pill container. In particular, the invention is a pill container having compartments associated with different days of the week and different times of those days, for holding pills to be taken at such times, wherein the compartments are easily removable from the container to insert and remove the pills therefrom.

Taking pills and medications on a regimented schedule is a common task for many people, especially the elderly. It is often difficult to remember how many and what kind of pills need to be taken, and whether or not the necessary pills had already been taken. Depending on the medication being taken, it can be dangerous to a person's health or mental well being if a dosage is missed or accidentally exceeded because the person forgot that they already took the proper dosage.

U.S. Pat. No. 4,890,741 to Edelstein discloses a capsule package including a medication storage compartment with a child-resistant cap assembly, and a smaller compartment for receiving the cap assembly of another receptacle. Instructions for taking the medication may be stored in the smaller compartment. However, Edelstein is intended for holding a bulk quantity of each medication in each container, it is not suitable for pre-organizing the dosages to be taken at future times.

U.S. Pat. No. 5,720,392 to Price discloses a prescription timer for indicating when a person took a pill or when he/she is next scheduled to take a dose of medication. The timer may be attached to a pill bottle having a cap. However, Price only provides a single compartment, making it unsuitable for use with multiple medications.

U.S. Pat. No. 5,899,335 to Boyer et al. discloses a medication container, including a method for using the container. The container takes the form of a clock face, with compartments corresponding to the hours of the day. Boyer is best suited for a person who must take medication at virtually every hour of the day. However, Boyer does not allow a user to pre-arrange medication for a period longer than a single day.

Thus, there exists a need for a multi-compartment pill container wherein the compartments are removable. The compartments are labeled and arranged according to the days of the week, and are further divided and labeled according to different times of the day, namely "AM", "Noon", "Evening", and "Bed". A full week's worth of medication may be inserted into the container, and removed at the appropriate time.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved multi-compartment pill container. As such, the general purpose of the present invention, which will be described subsequently in greater detail, is to provide a new and improved multi-compartment pill container which has all the advantages of the prior art and none of the disadvantages.

To attain this, the present invention essentially comprises a multi-compartment pill container constructed to hold a week's worth of medication. The container has a housing tray, a number of removable compartments selectively held within the housing within rectangular openings, and a lid attached to the housing and extending over the compartments. Each compartment has indicia indicating the day of the week and is divided into chambers by separation walls. Each chamber has a chamber cover on which indicia is printed corresponding to a time of day. At the correct time, the user may remove the compartment from the housing and ingest the medication from the appropriate chamber. The container also includes a telescopic drinking cup and a timer. Each compartment may be completely removed from the housing to allow the user to carry the compartment separate from the entire container.

It is an object of the invention to produce a multi-compartment pill container that alerts a user when the next scheduled dose of medication should be taken. Accordingly, the container has a timer that emits an audible tone at preset intervals, thereby bringing to the user's attention that it is time to take medication.

It is a further object of the invention to produce a multi-compartment pill container that provides the necessary medication to the user for each day. Accordingly, the container has various removable compartments corresponding to the days of the week and is subdivided into individual compartments which hold the pills necessary for each time of the day.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
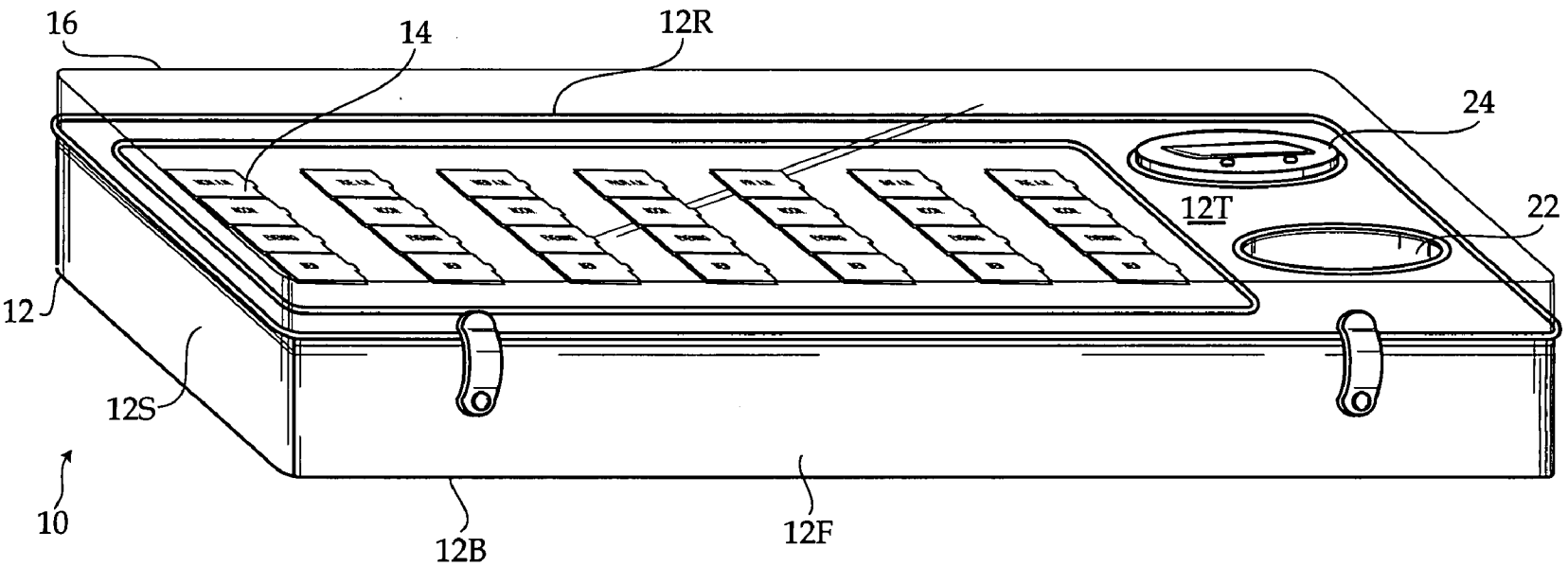
FIG. 1 is a perspective view of the multi-compartment pill container.
Figure 2:
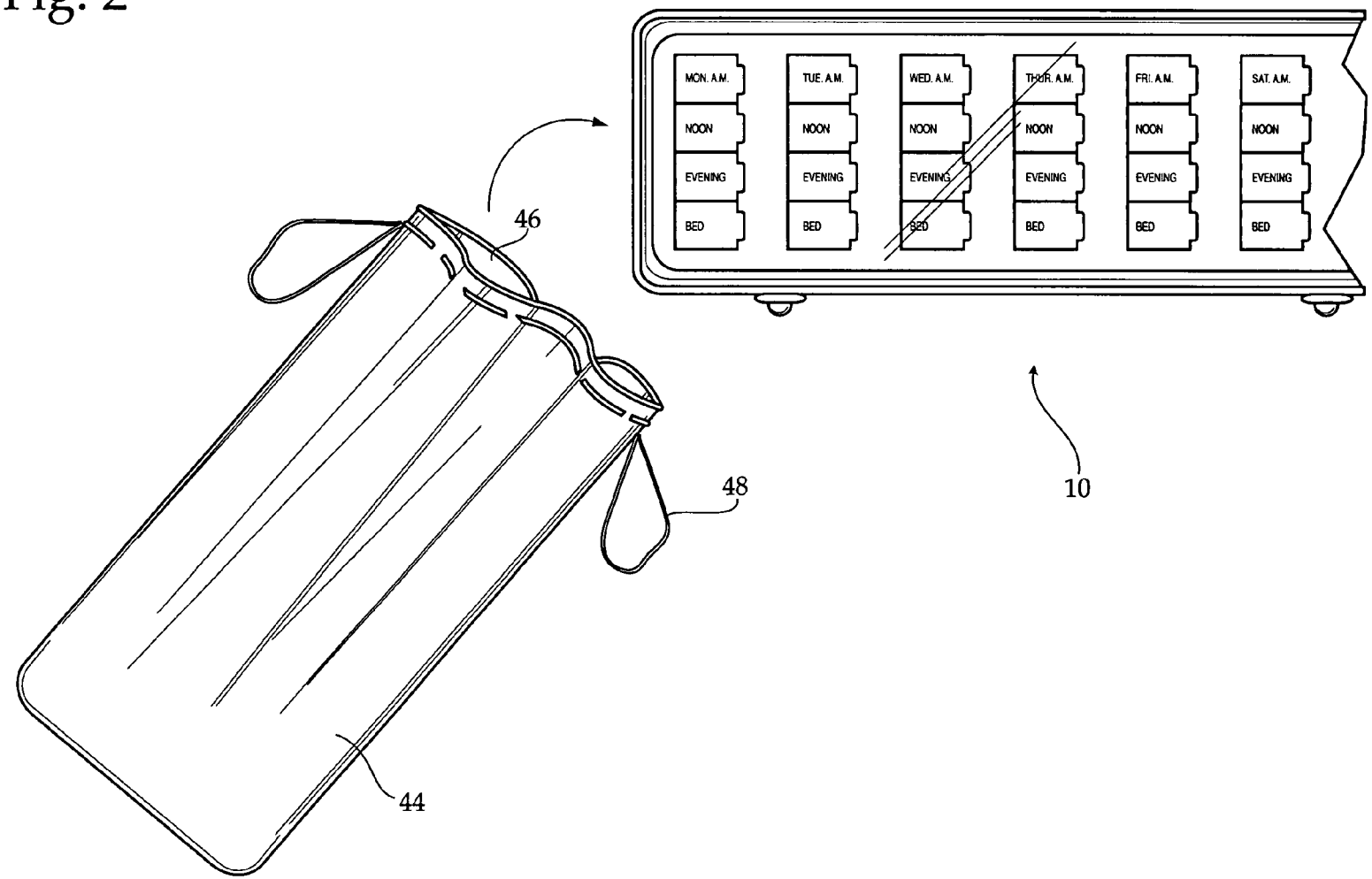
FIG. 2 is a top elevational view of the container being placed in a carrying case.

10 multi-compartment pill container
11 medication
12 housing
12A housing top edge
12T housing top surface
12B housing bottom surface
12S housing side wall
12F housing front side wall
12R housing rear side wall
13 housing top edge lip
14 compartment
16 lid
16R lid rear wall
16F lid front wall
18 rectangular opening
20 circular hole
22 drinking cup
24 timer
26 timer button
28 LED display

30 speaker
32 compartment chamber
32T chamber top edge
32B chamber bottom surface
34 chamber cover
34T chamber cover top surface
36 separation
38 indicia
40 flange
42 clip
44 pouch
46 pouch top opening
48 drawstrings

DETAILED DESCRIPTION OF THE PREFERRED EMBODIMENTS

FIG. 1 illustrates a multi-compartment pill container 10 constructed to hold a week's worth of medication 11 for a user. The container 10 essentially comprises a housing 12, a plurality of selectively removable compartments 14 held within the housing 12, and a lid 16 selectively attached to the housing 12 and extending over the compartments 14.

The housing 12 is rectangular in shape, having a top surface 12T, a top edge 12A, a bottom surface 12B, two side walls 12S, a front wall 12F, and a rear wall 12R, said walls 12S, 12F, 12R extending between the top and bottom surfaces 12T, 12B. A lip 13 extends outward from the top edge 12A, along the housing perimeter. The top surface 12T has a plurality of rectangular openings 18 extending vertically downward into the housing 12, substantially from the top surface 12T to the bottom surface 12B, and substantially from the rear wall 12R to the front wall 12F of the housing 12. These openings 18 are each sized to accommodate one of the compartments 14. Accordingly, one compartment is provided for each day of the week—for a total of seven compartments. Correspondingly, seven rectangular openings 18 are provided, each extending from near the front wall 12F to near the rear wall 12R, and spaced apart between the side walls 12S.

Also situated on the housing top surface 12T are a pair of circular holes 20, said holes 20 extending between the top surface 12T and the bottom surface 12B of the housing 12. One of these holes 20 accommodates a telescopic drinking cup 22. The drinking cup 22 is collapsible to fit within the hole 20, between the top surface 12T and the bottom surface 12B. Once removed from the housing 12, the cup 22 may be expanded to hold a quantity of water. Thus, when taking medication, the user has a cup readily available for filling with water in order to help swallow the medication 11.

Adjacent to the drinking cup 22 is a timer 24, said timer 24 situated within the other of the circular holes 20. The timer 24 has a pair of programming buttons 26, an time display 28, and a speaker 30 from which audible tones are selectively emitted. One of the buttons 26 allows the user to program the hour and minute for which the timer 24 will sound, while the second button 26 allows the user to turn the timer 24 on and off, as necessary. However, the specific manner of programming may be altered in numerous ways, as would be appreciated by one of ordinary skill in the art. The timer 24 may be programmed for a specific time interval, said interval viewable on the time display 28. Once the time interval expires, a tone is emitted from the speaker 30, indicating to the user that it is time to take medication 11. Preferably, the timer is programmed to provide four alarms, such that the alarms occur in the morning, noon, evening, and bed times, so as to signal the person that medication appropriate to those times of day should be taken.

The compartments 14 each have a bottom surface 14B, a top edge 14T, and four side walls 14S, all defining an interior volume wherein medication 11 is stored. Three separation walls 36 extend vertically within each compartment 14, thereby completely dividing each compartment 14 into four separate chambers 32, namely a first chamber 32A, a second chamber 32B, a third chamber 32C, and a fourth chamber 32D. The first and fourth chambers 32A, 32D are defined by three side walls 14S of the compartment 14 and one of the separation walls 36, and the second and third chambers 32B, 32C are defined by two side walls 14*s* of the compartment 14 and two of the separation walls 36. Chamber covers 34 extend over each chamber 32, thereby containing the contents therein. Each cover 34 has a top surface 34T on which indicia 38 are printed. The indicia 38 include portions of the day (i.e. "AM", "Noon", "Evening", and "Bed"). The cover 34 on the first chamber 32 also includes the abbreviations for the days of the week (i.e. "Mon", "Tues", "Wed", "Thurs", "Fri", "Sat", and "Sun"). Each chamber cover 34 has a flange 40 by which the cover 34 can be opened upward, thus revealing the contents of the chamber 34. The flanges 40 also overhang the rectangular openings and thereby facilitate removal of the compartments 14 from said rectangular openings 18.

Figure 3:
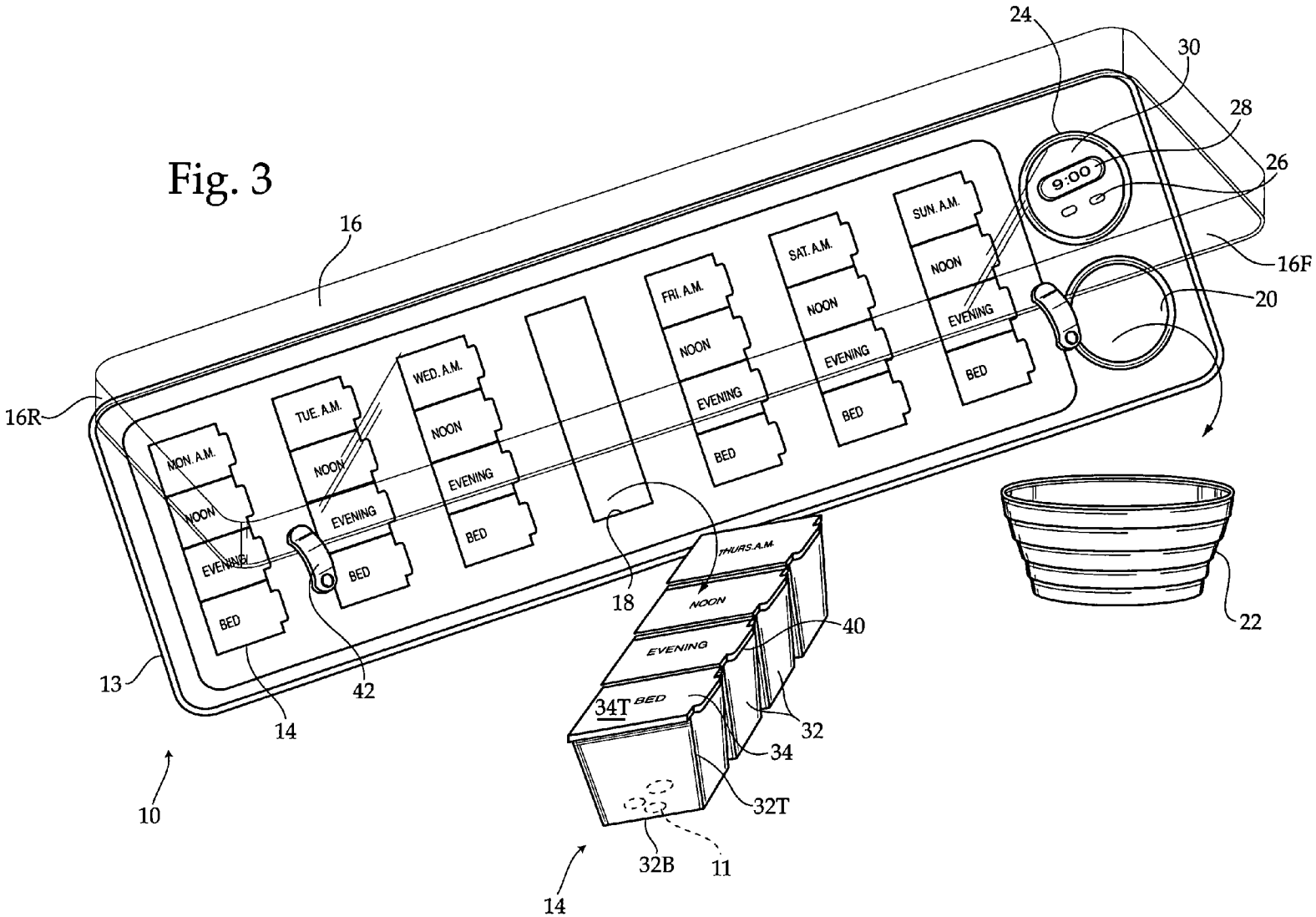
FIG. 3 is a perspective view of the container with the lid in the open position, illustrating a compartment and a drinking cup removed from the container.

Each compartment 12 may be completely removed from the housing 12, as illustrated in FIG. 3, facilitating filling the compartment with the appropriately scheduled medication or easy removal of medication by carefully tilting the compartment to allow the medication to fall therefrom. In addition, the user might choose to carry the compartment separate from the entire container 10, so as to only carry the medication needed for one particular day.

The container lid 16 extends over the top surface 12T of the housing 12 and covers all of the compartments 14 as they are seated within their rectangular openings 18, said lid 16 having a rear wall 16R and a front wall 16F. The rear wall 16R of the lid is attachable to the housing rear wall 12R. Clips 42 are secured to the lid front wall 16F, said clips 42 being selectively mateable with the housing lip 13 to selectively maintain the lid in the closed position.

A pouch 44 is also available in which the container 10 may be stored when not in use, or so that it can be carried inconspicuously. The pouch 44 has a top opening 46 through which the container 10 is inserted. Drawstrings 48 encircling the top opening 46 are used to cinch said top opening 46 to prevent the container 10 from slipping out of the pouch 44.

In use, appropriate doses of medication are placed in the compartments 14 of the container 12 according to the prescribed times. The chamber covers 34 are lifted by the flange 40 and the medication is inserted into the appropriate chambers 32 according to the time of day indicated by the indicia 38 on the chamber covers 34. The timer 24 may then be set using the programmable buttons 26 to emit an audible tone when the medication needs to be taken. Preferably, the timer 24 will sound an alarm four times a day, corresponding directly to the times of day of the indicia 38 on the covers 34 of one of the compartments 14. Accordingly, an alarm will be emitted in the morning, at noon time, in the evening, and at bed time to indicate that the medication in the compartments 14 bearings such indicia should be taken. In this regard however, the specific times of day may still be adjusted by the user—such as to define the user's particular definition of "bed time", or an appropriate "morning" time after the person would normally have awoken. In addition, if desired, one of the compartments 14 for the present day of the week may be removed from the container 10 and carried on the user, rather than having to transport the entire container 10.

In conclusion, herein is presented a multi-compartment pill container. The invention is illustrated by example in the drawing figures, and throughout the written description. It should be understood that numerous variations are possible, while adhering to the inventive concept. Such variations are contemplated as being a part of the present invention.

What is claimed is:

1. A multi-compartment pill container for holding a quantity of medication, comprising:

a housing, the housing having a top surface, two side walls, a front wall, and a rear wall, wherein the top surface has seven top surface openings extending vertically downward into the top surface of the housing, the housing top surface further comprises a circular hole, said hole extending between the top surface and the bottom surface of the housing;

a drinking cup which fits within said hole to provide the user with a means for drinking a liquid to facilitate the taking of medication;

a container lid extending over the top surface of the housing, the lid having a front wall, a rear wall attached to the housing rear wall, and clips secured to the lid front wall, wherein the clips are selectively mateable with the housing lip;

seven compartments, each compartment corresponding to a day of the week and selectively mateable with one of the housing top surface openings, each compartment being selectively removable from the housing, said compartment having a bottom surface, a top edge, four side walls, and a plurality of separation walls extending vertically between the bottom surface and the top edge, wherein the separation walls divide each compartment into four chambers, each chamber corresponding to a time of day, and a chamber cover extends over each chamber, each chamber cover having a top surface and a flange extending outward from the top surface for opening the cover, each chamber cover having indicia printed on the top surface that indicates a portion of the day, such as "AM", "Noon", "Evening", and "Bed", and also indicates one of the days of the week; and a timer, the timer capable of sounding alarm four times per day for each of the chambers in one of the compartments.

2. The multi-compartment pill container as recited in claim 1, wherein the housing top surface has another circular hole, and wherein the timer is circular and is sized to be selectively mateable with said other circular hole.

3. The multi-compartment pill container as recited in claim 2, wherein the cup is telescoping.

4. The multi-compartment pill container as recited in claim 3, further comprising a pouch sized to accommodate the container, the pouch having a top opening through which the container is inserted and drawstrings encircling the top opening used to cinch said top opening to prevent the container from slipping out of the pouch.

* * * * *